United States Patent [19]

Donaldson

[11] Patent Number: 4,636,145

[45] Date of Patent: Jan. 13, 1987

[54] DOWN-WELL PUMP DEVICE

[76] Inventor: Thomas W. Donaldson, 2460 Lemon Ave., Signal Hill, Calif. 90806

[21] Appl. No.: 737,800

[22] Filed: May 28, 1985

[51] Int. Cl.[4] ..... F04B 23/08

[52] U.S. Cl. ..... 417/199 R; 417/320; 417/362; 415/5; 415/6

[58] Field of Search ..... 417/362, 201, 199 R, 417/320; 415/5, 6

[56] References Cited

U.S. PATENT DOCUMENTS

| | | | |
|---|---|---|---|
| 1,389,428 | 8/1921 | Gartling | 415/5 X |
| 1,438,225 | 12/1922 | DeVille | 417/362 |
| 1,444,180 | 2/1923 | Gartling | 417/320 |
| 1,951,919 | 3/1934 | Arutunoff | 417/362 |
| 3,485,181 | 12/1969 | Hahs | 417/362 |
| 3,774,685 | 11/1973 | Rhodes | 415/5 X |
| 4,529,363 | 7/1985 | Suzuki | 417/362 X |

*Primary Examiner*—Carlton R. Croyle
*Assistant Examiner*—Paul F. Neils
*Attorney, Agent, or Firm*—Lyon & Lyon

[57] ABSTRACT

A pump is positioned in the oil producing zone of a well to pump fluid therefrom and is driven by an oil accumulating chain used to recover oil from the well in conjunction with associated secondary drive means.

16 Claims, 10 Drawing Figures

10
11
12
14
5
8
16
6
9
7
3
4
2
28
64
30

DOWN-WELL PUMP DEVICE

BACKGROUND OF THE INVENTION

The field of the present invention is down-well fluid pumping systems to remove fluid from oil wells, particularly wells wherein oil recovery is by means of an endless oil accumulating chain.

Viscous oil may be recovered from certain oil wells by means of an endless oil accumulating chain having a loop portion suspended into the oil producing region of the well. Ideally, oil flows out of the surrounding oil producing strata into the bottom portion of the well at a rate sufficient to permit oil recovery by the oil accumulating chain without excessive well draw-down. Often, however, water is associated with oil production. This water tends to separate out and form a layer below the oil, thus occasionally preventing oil from flowing into the well a preferred rate. It then becomes necessary, if efficient oil recovery is to be achieved, to pump the separated water from the bottom portion of the well. For this purpose, pump means must be employed which are capable of pumping water from well depths in excess of 1,000 feet. At the same time such pump means must be operable in conjunction with the oil accumulating chain without interfering with chain operation. Lastly, it is desirable that such pump means also be relatively inexpensive to manufacture, install, operate and maintain.

SUMMARY OF THE INVENTION

The instant invention is directed to a device for removing water from an oil well to facilitate the recovery of oil by an endless oil accumulating chain. A down-well pump is positioned in the oil producing zone of the well, below the terminus of the chain loop, and is driven by the endless oil accumulating chain to pump excess water from the well. Down-well pump drive components are provided to transfer power from the chain loop terminus to the pump. The pump and pump drive components are mounted inside a weight member which is also used to retain the oil accumulating chain in position in the well. Fluid inlet and fluid outlet means are provided to transfer fluid to and from the pump, respectively.

The advantages of driving the down-well pump with the oil accumulating chain are several. First, the chain is already powered by an above-ground power source, thus, secondary power means are unnecessary. Second, utilizing the oil accumulating chain rather than a separate pump drive means avoids cluttering the well casing and interfering with the operation of the oil accumulating chain. Finally, because there are fewer drive elements, manufacturing, installation, operation and service costs are reduced.

Accordingly, it is an object of this invention to achieve the above advantages by providing a novel means for removing water from a well wherein a down-well pump is powered by a driven oil accumulating chain used to recover oil from the well. Other objects and advantages of the present invention will be apparent from the following description.

DESCRIPTION OF THE PREFERRED EMBODIMENTS

Figure 1:
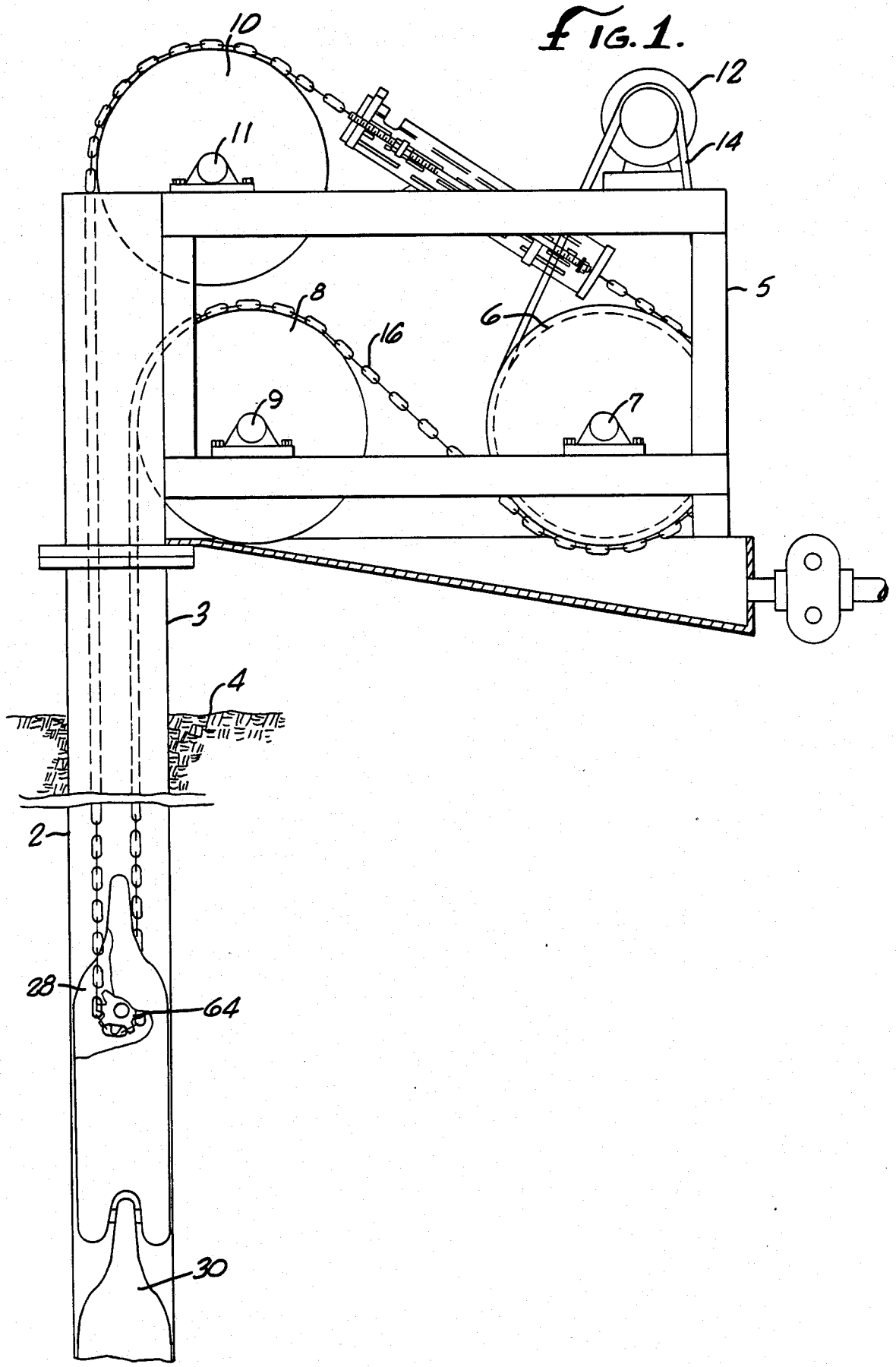
FIG. 1 is a side elevation of a system incorporating an embodiment of the present invention.

Referring to FIG. 1, a well 2 may have the usual casing 3 extending above ground level 4. A platform 5 is supported in any acceptable fashion above the ground level and has a series of sprockets 6, 8 and 10 journaled on shafts 7, 9 and 11, respectively, which shafts are rotatably supported in platform 5 in the usual manner. Drive sprocket 6 is driven clockwise by a variable speed motor 12 through chain drive 14. Looped around sprockets 6, 8 and 10 is endless oil accumulating chain 16. A loop portion of chain 16 is looped down-well casing 3, terminating at a sprocketed down-well idler pulley 64.

Figure 2A:
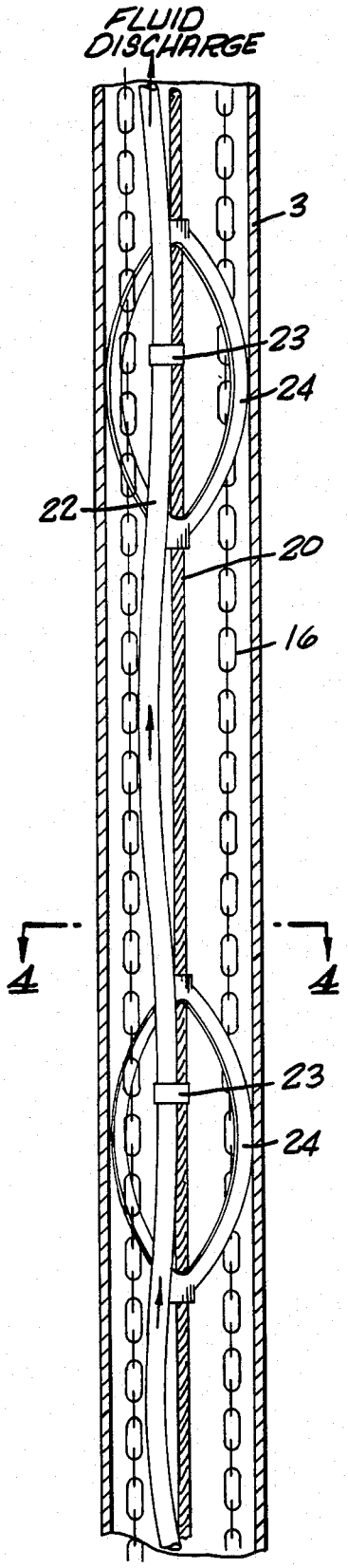
FIG. 2*a* is a cutaway view of a portion of a well casing taken above the terminus of a chain loop.
Figure 2B:
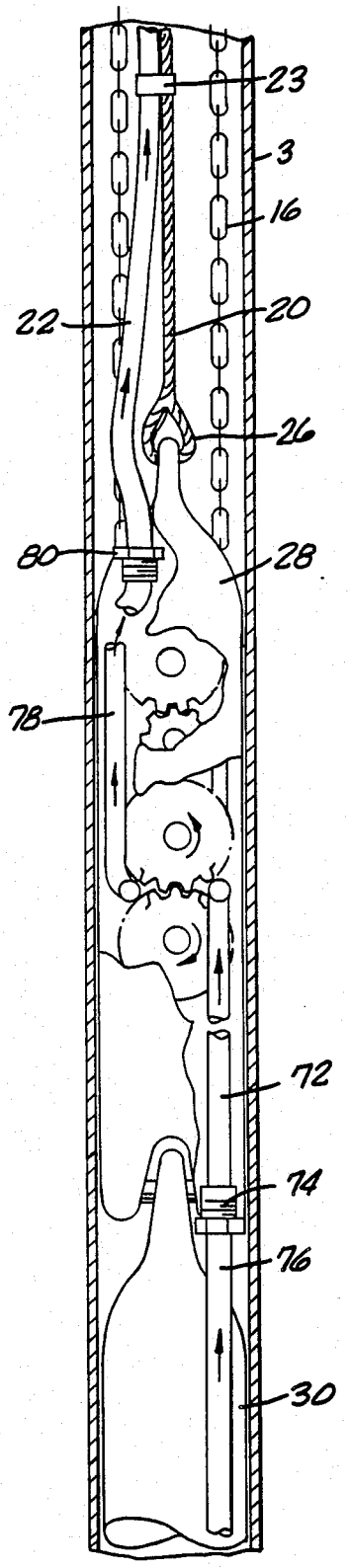
FIG. 2*b* is a cutaway view of a portion of a well casing taken about the terminus of the a chain loop.
Figure 4:
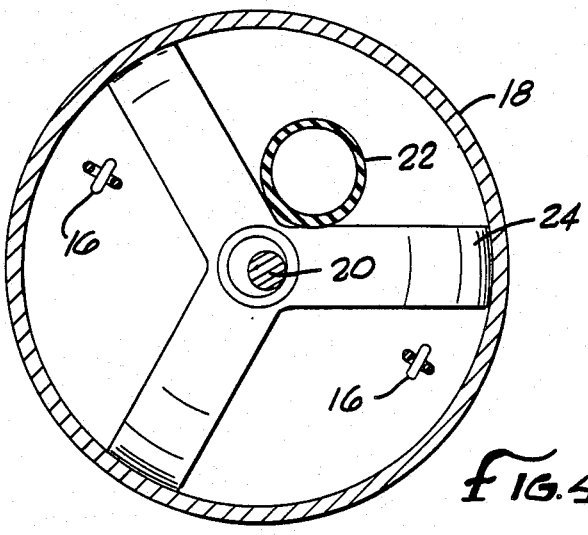
FIG. 4 is a cross-sectional view of a well casing taken on line 4—4 of FIG. 2*a*.

Referring to FIGS. 2*a* and 2*b*, chain 16 is shown extending down-well casing 3. Also extending down-well casing 3 are cable 20 and fluid discharge tube 22. Discharge tube 22 is attached to and supported by cable 20 by means of bands 23. Mounted on cable 20 at suitable intervals are cable centering braces 24. The arrangement of well casing 3, chain 16, cable 20, discharge tube 22 and centering brace 24 is also shown in FIG. 4.

Figure 2C:
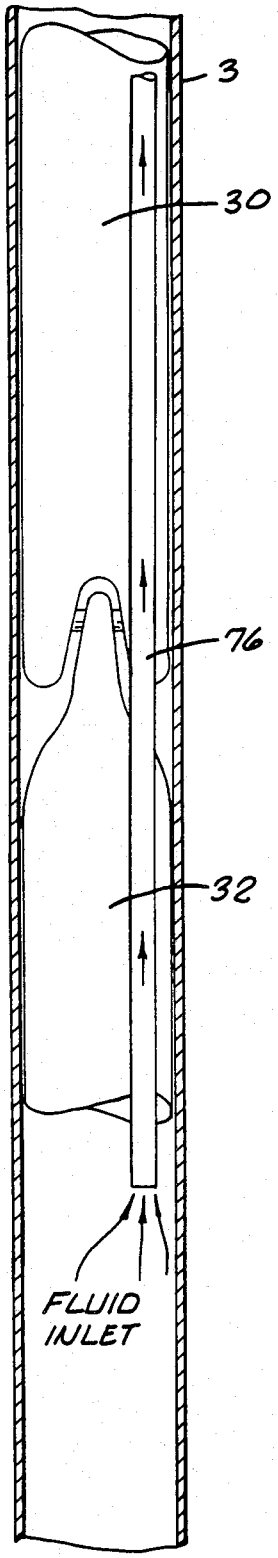
FIG. 2*c* is a cutaway view of a portion of a well casing taken below the terminus of a chain loop.

Referring to FIGS. 2*b* and 2*c*, at the end of cable 20, attached to cable loop 26, are weight members 28, 30 and 32 to maintain chain 16 in position down the well casing 3. While weight members 30 and 32 may be formed in any suitable fashion, weight member 28 is unique in that it houses downhole gear pump and pump drive components.

Figure 3:
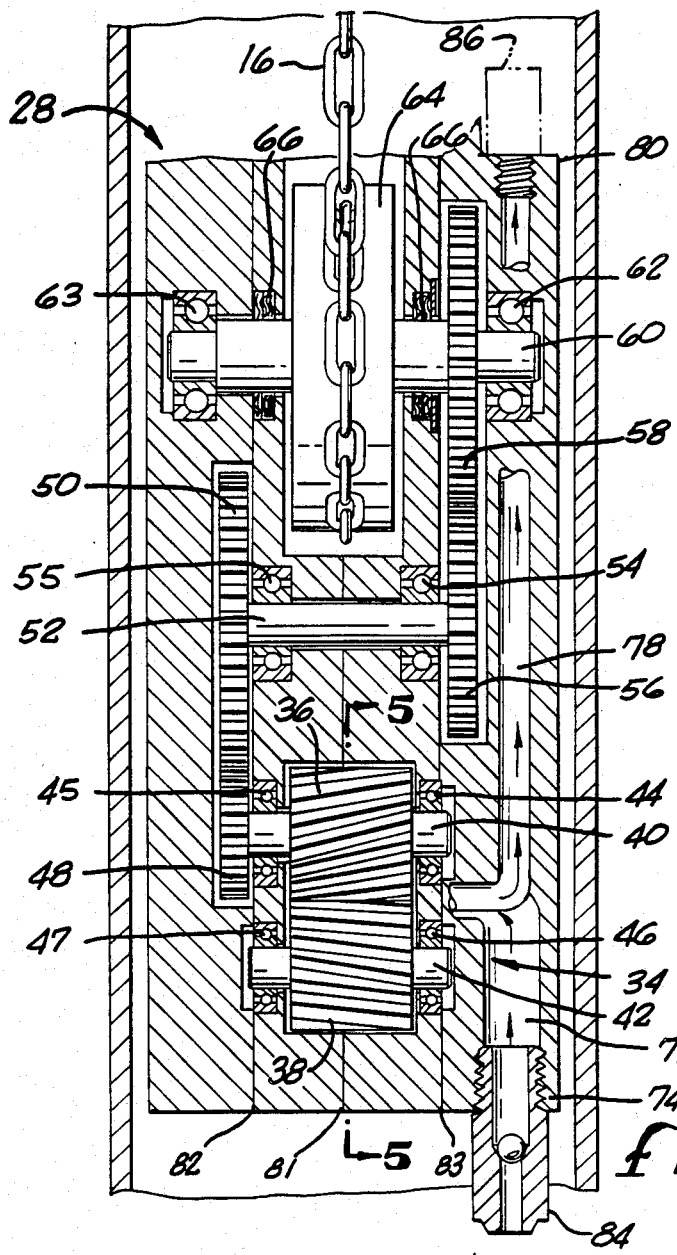
FIG. 3 is a cutaway view of a well casing showing a pump and associated drive means.

Referring to FIG. 3, oil accumulating chain 16 drives pump 34 through a down-well power transfer system now to be described. As oil accumulating chain 16 is driven, sprocketed drive pulley 64 rotates shaft 60, which is supported by bearings 62 and 63 mounted in housing 28. As shaft 60 rotates, drive gear 58, attached thereto, adjacent bearing 62, rotates therewith. Drive gear 58 in turn engages and rotates idler gear 56 which is mounted on shaft 52, adjacent bearing 54. Rotation of idler gear 56 induces rotation in idler gear 50, which is also mounted on shaft 52, adjacent bearing 55. Bearings 54 and 55 are mounted in housing 28 and support shaft 52. Idler gear 50 in turn engages and rotates pump drive gear 48 which is attached to shaft 40, adjacent bearing 45. Shaft 40 is supported by bearings 44 and 45 mounted in housing 28. As shaft 40 rotates, pump gear element 36 of gear pump 34 rotates therewith. Pump gear element 36 in turn engages pump gear element 38 causing it to rotate on shaft 42, which is supported by bearings 46 and 47 mounted in weight member 28.

Figure 5:
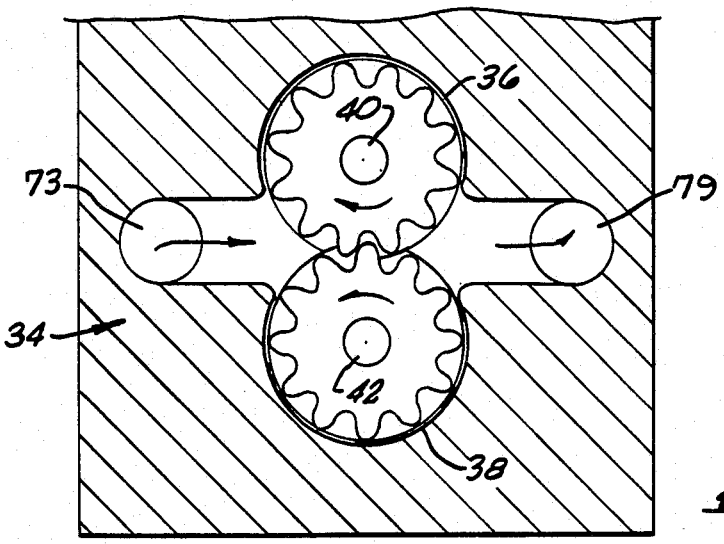
FIG. 5 is a cutaway view of a water pump taken on line 5—5 of FIG. 3 showing fluid pumping gears and inlet and outlet passages.

Referring to FIGS. 2*c*, 3, and 5, as pump gear elements 36 and 38 are caused to rotate by chain 16 through the above described system of gears and shafts, fluid is drawn into a fluid inlet system comprising fluid inlet tube 76, check valve 84, and fluid inlet passage 72. Entering fluid inlet tube 76, the fluid travels upwardly through the tube to check valve 84, which is inserted into threaded port 74 in the lower end of weight member 28. Check valve 84 serves to retain fluid in the pump and pump outlet system. Once past check valve 84, the fluid continues through integral inlet passage 72 in housing 28 and enters the pump inlet chamber 73.

Referring to FIG. 5, water enters pump 34 through fluid inlet chamber 73 and is carried circumferentially around the gear teeth until they converge, at which point the fluid is forced to exit the pump through fluid outlet chamber 79.

Referring to FIGS. 2*b*, 3 and 5, upon exiting fluid outlet chamber 79, the fluid enters a fluid outlet system comprising fluid outlet passage 78, pressure relief valve 86, and discharge tube 22. Entering integral outlet passage 78 in housing 28, the fluid travels upwardly through the passage to pressure relief valve 86, which is inserted in threaded port 80 at the upper end of the housing. Relief valve 86 prevents pump stage overload and over-pressuring of the discharge system. It also facilitates adjustment of a discharge system flow control valve at the surface. Once past pressure relief valve 86, the fluid continues through discharge tube 22, attached to relief valve 86, and exits the system at a fluid outlet on the surface.

Figure 6:
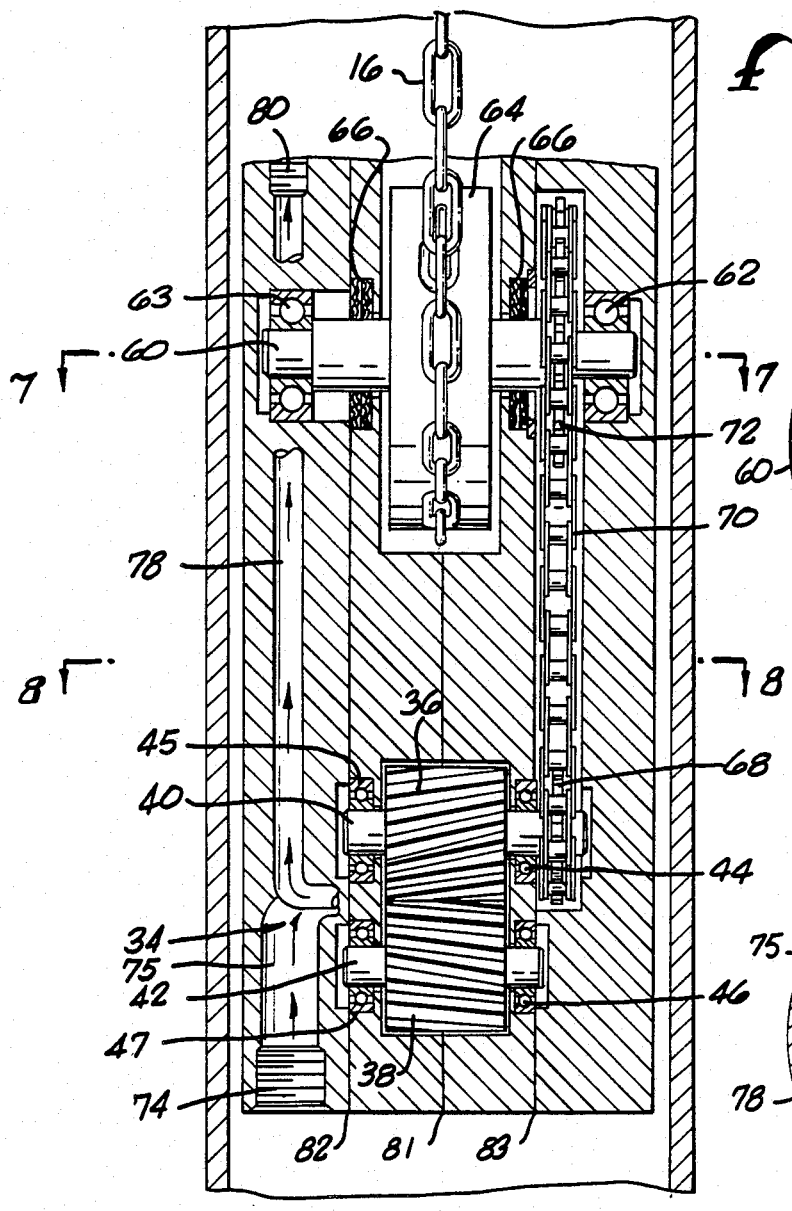
FIG. 6 is a cutaway view of a well-casing showing a second embodiment of the present invention.
Figure 7:
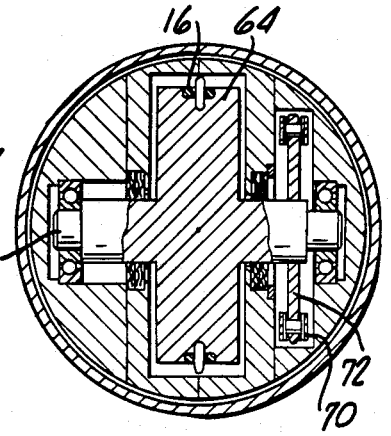
FIG. 7 is a cross-sectional view of a weight member taken along line 7—7 of FIG. 6.
Figure 8:
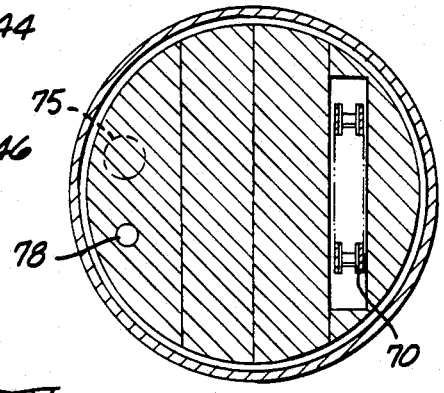
FIG. 8 is a cross-sectional view of a weight member taken along line 8—8 of FIG. 6.

A second embodiment of the present invention, incorporating a modified down-well power transfer system, is shown in FIG. 6. In this embodiment, a pump drive sprocket 68 is mounted on shaft 40. A drive chain 70 loops around sprocket 68 and around a sprocket 72 mounted on shaft 60, thus enabling chain 16 to drive the pump gear elements 36 and 38.

Referring to FIGS. 3 and 6, housing 28 is split along parting lines 81, 82 and 83 to facilitate assembly of internal components. Separate sections are assembled with suitable fasteners and with the use of sealing compounds suitable to withstand operating pressures and which are insoluble and impervious to the surrounding fluids and contaminants. Seal means 66 mounted in housing 28, on shaft 60, are also provided to prevent oil, water and other contaminants from contacting bearings 62 and 63 and other internal components.

While what has been hereinbefore described represent the preferred embodiments of this invention, it is readily apparent that alterations and modifications can be resorted to without departing from the scope of this invention. For example, although only a single stage gear pump is employed in the embodiments described herein, pump 34 may be any conventional gear pump having one or more stages depending on the operating characteristics required. These and other alterations and modifications are possible without departing from the inventive concepts herein and are intended to be included within the scope of the appended claims.

What is claimed is:

1. A device for pumping fluid from a well comprising:

a pump positioned in the well;

a motor positioned outside of the well;

a driven endless oil-accumulating chain for recovering oil from the well having a loop portion suspended down the well extending between said motor and said pump through which said motor drives said pump;

a fluid inlet and a fluid discharge in fluid communication with said pump.

2. The device set forth in claim 1 wherein said pump is positioned in said well by suspension means including spacers to retain said suspension means substantially in the center of said well.

3. The device set forth in claim 1 wherein said oil accumulating chain drives said pump through a down-well power transfer system to transfer power from said chain to said pump.

4. The device set forth in claim 3 wherein said chain is looped around a down-well idler member.

5. The device set forth in claim 4 wherein said down-well power transfer system comprises a series of interconnecting gears.

6. The device set forth in claim 4 wherein said down-well power transfer system comprises a pair of sprockets and an interconnecting drive chain looped around said sprockets.

7. A device for pumping fluid from a well comprising:

a motor positioned outside of the well;

an endless oil accumulating chain for recovering oil from the well, said chain being driven by said motor and having a loop portion suspended down the well;

a pump driven by said chain and positioned in said well below said chain loop;

a fluid inlet system providing fluid communication between a down-well fluid inlet and said pump; and a fluid outlet system providing fluid communication between said pump and a fluid discharge.

8. The device set forth in claim 7 wherein said pump is positioned in said well by suspension means including spacers to retain said suspension means substantially in the center of said well.

9. The device set forth in claim 7 wherein said pump is driven by said chain through a down-well power transfer system.

10. The device set forth in claim 9 wherein said pump and down-well power transfer system are mounted in a housing.

11. The device set forth in claim 10 wherein said fluid inlet and fluid outlet systems comprise, respectively, an integral fluid inlet passage and an integral fluid outlet passage disposed in said housing.

12. The device set forth in claim 11 wherein said fluid inlet and fluid outlet systems further comprise tubes to transfer fluid from a fluid source inside said well to said integral fluid inlet passage and to transfer fluid from said integral fluid outlet passage to a fluid discharge, respectively.

13. The device set forth in claim 9 wherein said chain is looped around a down-well idler member.

14. The device set forth in claim 13 wherein said down-well power transfer system comprises a first sprocket driven by said down-well idler member through a shaft, a drive chain looped around said first sprocket and around a pump drive sprocket connected by a shaft to said pump.

15. The device set forth in claim 13 wherein said pump comprises fluid pumping gears and a pump drive gear to drive said fluid pumping gears.

16. The device set forth in claim 15 wherein said down-well power transfer system comprises a first gear driven by said down-well idler member through a first shaft, a second gear enmeshed with said first gear, a third gear enmeshed with said pump drive gear and driven by said second gear through a second shaft.

* * * * *